US011969628B2

(12) United States Patent
Sallinen et al.

(10) Patent No.: US 11,969,628 B2
(45) Date of Patent: Apr. 30, 2024

(54) TRAMPOLINE

(71) Applicant: Acon Finland Oy Ltd, Oulu (FI)

(72) Inventors: Tuomas Sallinen, Oulu (FI); Jari Kiviniemi, Siikajoki (FI)

( * ) Notice: Subject to any disclaimer, the term of this patent is extended or adjusted under 35 U.S.C. 154(b) by 0 days.

(21) Appl. No.: 18/028,836

(22) PCT Filed: Sep. 23, 2021

(86) PCT No.: PCT/FI2021/000009
§ 371 (c)(1),
(2) Date: Mar. 28, 2023

(87) PCT Pub. No.: WO2022/064097
PCT Pub. Date: Mar. 31, 2022

(65) Prior Publication Data

US 2023/0285791 A1 Sep. 14, 2023

(30) Foreign Application Priority Data

Sep. 28, 2020 (FI) ..... 20207157

(51) Int. Cl.
*A63B 5/11* (2006.01)
*A63B 71/02* (2006.01)

(52) U.S. Cl.
CPC ..... *A63B 5/11* (2013.01); *A63B 71/023* (2013.01); *A63B 2210/50* (2013.01); *A63B 2225/09* (2013.01)

(58) Field of Classification Search
CPC ..... A63B 5/11; A63B 71/023; A63B 2210/50; A63B 2225/09
See application file for complete search history.

(56) References Cited

U.S. PATENT DOCUMENTS 2,590,049 A * 3/1952 Sidlinger ..... A63B 5/11 482/28
4,483,531 A 11/1984 Laseman
(Continued)

FOREIGN PATENT DOCUMENTS

CN 204910597 12/2015
FR 2766726 2/1999

OTHER PUBLICATIONS

CN204910597 English Language Machine Translation.
(Continued)

*Primary Examiner* — Andrew S Lo
*Assistant Examiner* — Andrew M Kobylarz
(74) *Attorney, Agent, or Firm* — Belay IP

(57) ABSTRACT

This disclosure relates to tiltable trampoline frame support structures that include a front support member, a rear support member, two elongated link members and two elongated adjusting link members. The front support member and the rear support member are pivotally coupled to frame members and are pivotal about a horizontal axis perpendicular to the front line of the trampoline. The horizontal link members are pivotally coupled between the front support member and the rear support member. The upper ends of the adjusting link members are pivotally coupled to the upper ends of the front support member and the lower ends of the adjusting link members are movable coupled to the horizontal link members in a such way that the tilt angle of the rebounding mat shifts when the coupling place of the adjusting link members to the horizontal link member is adjusted.

14 Claims, 7 Drawing Sheets

(56) References Cited

U.S. PATENT DOCUMENTS

| | | | | |
|---|---|---|---|---|
| 5,007,638 | A * | 4/1991 | Yukl | A63B 69/0097 482/28 |
| 2005/0137061 | A1* | 6/2005 | Wang | A63B 5/11 482/28 |
| 2011/0021321 | A1* | 1/2011 | Legg | A63B 5/11 482/29 |
| 2020/0222738 | A1* | 7/2020 | Kuo | A63B 5/11 |

OTHER PUBLICATIONS

FR2766726 English Language Machine Translation.
Communication of Acceptance from the Finnish Patent and Registration Office, App. No. 20207157, Applicant: Acon Final Oy Ltd, Mar. 31, 2021.
OEE Workproduct, Written Opinion of the International Searching Authority, for PCT/FI2021/000009, dated Dec. 2, 2021.

* cited by examiner

TRAMPOLINE

CROSS REFERENCE TO RELATED APPLICATIONS

This application is a national phase of international application PCT/FI2021/000009, filed Sep. 23, 2021, which claims the benefit of priority to Finnish patent application 20207157, filed 28 Sep. 2020, the content of both applications of which are herein incorporated by reference.

BACKGROUND OF THE INVENTION

Field of the Invention

The invention relates to a trampoline comprising a substantially rectangular rebounding mat, a plurality of frame members, a plurality of spring elements arranged between the rebounding mat and the frame members, and a support arrangement underlying the rebounding mat and the frame members.

Description of Related Art

Trampolines are commonly used in outdoor and indoor activities. Trampolines comprise a frame and a rebounding mat connected to the frame with stretching elements such as springs or similar. Further trampolines comprise legs or a frame support structure that is connected to the frame to rise it above the ground.

There are different types of trampolines for different use. Outdoor trampolines have a diameter of 3 to 5 meters and the mat of said devices is located at least 60 to 100 centimeters above the ground and are generally used at home on backyards for jumping exercises and stunts on the said devices. Mini trampolines have a diameter of 100 to 150 centimeters and the mat of said devices is positioned 20 to 35 centimeters above the ground and are generally used at home or in gyms for rocking, swinging and slight jumping exercises.

In addition to the outdoor trampolines (it must be noted that outdoor trampolines can be used indoors if the facility is suitable, i.e. large enough) and mini trampolines, there are so called gymnastic trampolines, which are high performance rebounders used for gymnastic jumps and stunt jumps. The rebounding mat of said devices is generally substantially rectangular or square with a diameter of 1 to 2 meters and the mat is positioned 30 to 80 centimeters above the ground. Unlike outdoor trampolines and mini trampolines that are used for jumping on the device, the gymnastic trampolines are generally used for jump on and off the said device.

In some gymnastic trampolines the frame support structure can be adjusted to tilt the angle of the rebounding mat towards the front side of the trampoline. The angle of the rebounding mat is generally tiltable to angles between 0 to 25 degrees. As the device is used for jump on and off, the tilting of the mat is advantageous and is used to direct the rebound direction of a jump.

Patent publications U.S. Pat. Nos. 4,225,131A, 6,162,061A and US20130210590A1 disclose mini trampolines with adjustable frame support structure in order to tilt the angle of the rebounding mat. The adjustment is arranged with telescoping adjustable extensions or telescoping legs. However, the structures that the publications describe are not suitable for gymnastic trampolines and for jumping on and off, because they are not stable enough and lack required durability and rigidity.

Utility model publication CN203577218U discloses a gymnastic trampoline with substantial square frame for a rebounding mat and adjustable frame support structure in order to tilt the angle of the rebounding mat. The frame support structure that the publication describes comprises front and rear support pedestals that are pivotally coupled to the frame of the mat and are separately tiltable in order to tilt the angle of the mat. The adjustment is arranged with telescoping regulating shafts. The telescoping regulating shafts for the front support pedestal are pivotally coupled to the front bar of the frame of the mat and the telescoping regulating shafts for rear support pedestal are pivotally coupled to the rear bar of the frame of the mat. The structure that the publication describes may be suitable for gymnastic trampolines, but the adjustment process of four separate telescoping regulating shafts is quite cumbersome by one person in practice. In addition, the front and rear bars of the frame of the mat, which are required for the coupling of the telescoping regulating shafts, are safety risks when a device is used for jumping on and off for paced stunts.

There is a clear need for a simple, reliable and easy to use, tiltable trampoline frame support structure.

SUMMARY OF THE INVENTION

The object of the invention is a solution that can significantly reduce the disadvantages and drawbacks of the prior art. In particular, the object of the invention is a solution where a device is trampoline structure that is stable, durable, safe and easy to adjust for various rebound angles.

The objects of the invention are attained with a device that is characterized by what is stated in the independent patent claim. Some advantageous embodiments of the invention are disclosed in the dependent claims.

The invention is a tiltable trampoline frame support structure that comprises a front support member, a rear support member, two elongated link members and two elongated adjusting link members. The front support member and the rear support member are pivotally coupled to a frame of a rebounding mat and are pivotal about a horizontal axis perpendicular to the front line of the trampoline. The horizontal link members are pivotally coupled between the front support member and the rear support member. The upper ends of the adjusting link members are pivotally coupled to the upper ends of the front support member and the lower ends of the adjusting link members are movable coupled to the horizontal link members. The front support member, the rear support member, the horizontal link members and the adjusting link members are configured in a such way that the tilt angle of the rebounding mat shifts when the coupling place of the adjustable link members to the horizontal link members is adjusted.

When reference is made in the text to the upper or the lower parts or respective directions such as down or up, or vertical or horizontal directions, a situation is described in which the trampoline according to the invention is in use. Also, when reference is made to the front, rear or side parts or directions, the trampoline is placed similarly and such a way that the front side is generally used to jump on the trampoline.

In one embodiment of the invention is a trampoline comprising a substantially rectangular rebounding mat, a plurality of frame members, a plurality of spring elements arranged between the rebounding mat and the frame members, and a support arrangement underlying the rebounding mat and the frame members. In one advantageous embodiment of the invention the support arrangement comprises a front support member, a rear support member, which support members each comprise two support member shafts having upper ends and lower ends of the support member shafts and an intermediate bar between said support member shafts. The support arrangement further comprises two horizontal link members and two adjusting link members having an upper end of the adjusting link member and a lower end of the adjusting link member, and the upper ends of support member shafts of the front support member and the rear support member are pivotally coupled to the frame members. The horizontal link members are pivotally coupled between the front support member and the rear support member. The upper ends of the adjusting link members are pivotally coupled to the upper ends of the support member shafts of the front support member and the lower ends of the adjusting link members are movable coupled to the horizontal link members. The front support member, the rear support member, the horizontal link members and the adjusting link members are configured in a such way that the tilt angle of the rebounding mat shifts when the coupling place of the adjustable link members to the horizontal link members is adjusted.

In a second embodiment of the trampoline, the coupling arrangement between the adjustable link member and the horizontal link member is a mounting bracket that is pivotally coupled to the lower end of the adjusting link member and is movable coupled on the horizontal link member.

In a third embodiment of the trampoline, the horizontal link members comprise multiple holes and the mounting brackets are locked up to the horizontal link members with locking pins that are fitted into the holes on the horizontal link members to set the tilt angle of the rebounding mat to desired predefined angles. The plurality of holes that are used to lock up the mounting brackets to predefined coupling places and to set the tilt angle of the frame and the rebounding mat to predefined angles. In some embodiment of the invention, the predefined tilt angles are 0, 5, 10, 15, 20 and 25 degrees towards the front side of the trampoline. This feature makes it easier to set the desired tilt angle of the rebounding mat.

In a fourth embodiment of the trampoline, the mounting bracket comprises an elastic element that drives the locking drop-in pin into the hole on the horizontal link member and ensures that the locking drop-in pin is in its locking position. This feature ensures that the trampoline frame support structure is locked up and safe to use.

In a fifth embodiment of the trampoline, the mounting bracket comprises a recess, and the locking drop-in pin comprises an elongated pin, a circular base collar with a substantially spiral raised surface perpendicular to the longitudinal axis of the pin comprising at least two chamfered surfaces. The locking drop-in pin is fitted in to the recess and the mounting bracket further comprises a substantially spiral raised surface corresponding to the spiral raised surface of the base collar, and the spiral raised surfaces of the recess and the base collar are configured in such a way that, when the locking drop-in pin is rotated in the recess, the chamfered surfaces of the recess and the locking drop-in pin force the locking drop-in pin to move outward from the recess and release the locking drop-in pin from its locking position. The locking drop-in pin is fitted in to a recess on one side of the mounting bracket and the recess has a circular inner wall and a spiral raised bottom surface that correspond to the shape of the base collar. The spiral raised surfaces of the recess and the base collar are configured in such a way that when the locking drop-in pin is rotated in the recess the locking drop-in pin moves perpendicular to its longitudinal axis out of the hole on the horizontal link member and the mounting bracket is unlocked up to the horizontal link member.

In a sixth embodiment of the trampoline, the planar chamfered surfaces have chamfering direction opposite each other and the angle of chamfering is between 15 and 30 degrees.

In a seventh embodiment of the trampoline, the angle of chamfering is between 20 and 25 degrees. This feature makes it easier to unlock the mounting bracket from the horizontal link member to be able to adjust the tilt angle of the rebounding mat.

In an eight embodiment of the trampoline, the locking drop-in pin is released from its locking position by pulling a handle that is coupled to the front end of the frame member and connected by a cable to the level member coupled to the base collar of the locking drop-in pin. This feature makes it easier to adjust the tilt angle of the rebounding mat and the adjustment can be easily made by one person.

In a ninth embodiment of the trampoline, the horizontal link member comprises locking slots and locking members on its both ends and the locking member comprises an L-shape slot configured in such a way that when the locking members are moved a certain distance outward from the horizontal link member, the locking slots open so that the horizontal link member can be decoupled from the front support member and the rear support member. The locking slot opens, and the horizontal link member can be detached from the front support member and the rear support member when the locking member is moved outward from the horizontal link member to the direction parallel to the longitudinal axis the horizontal link member. When the horizontal link members are detached from the front support member and the rear support member, the trampoline frame support structure can be folded down so that it takes less space. This feature makes it easier to store or transport the trampoline.

In a tenth embodiment of the trampoline, the horizontal link member is a telescopic pipe structure comprising an outer pipe, an inner pipe fitted into the outer pipe and adapted to move relative to the outer pipe, and a fixing pin that is fitted into fixing holes on the outer pipe and the inner pipe to fix the inner pipe in place. The length of the horizontal link member can be adjusted by extending the telescopic pipe structure. When the telescopic pipe structures of the horizontal link members are extended, the front support member and the rear support member are pivoted and the trampoline frame support structure is folded down so that it takes less space. This feature makes it easier to store or transport the trampoline. The inner pipe comprises multiple fixing holes so that the inner pipe can be fixed in at least two different place to set the length of the horizontal link member for the proper length for the normal operation mode and the folded mode.

In an eleventh embodiment of the trampoline, the support member shafts of the front support member and the support member shafts of the rear support member comprise elongated slots at the upper ends. The coupling between the support member shaft and the frame member can be loosen so that the coupling place of the support member shaft to the frame member can be moved away from the upper end of the support member shaft and thus in the folded mode the support member shaft can be pushed inwards to reduce the size of the trampoline frame structure. This feature makes it easier to store or transport the trampoline.

In a twelfth embodiment of the trampoline, the distance between the coupling places of the front support member and the rear support member to the horizontal link member is 60-70% longer than the distance between the coupling places of the front support member and the rear support member to the frame member and the distance between the coupling places of the frame member and the horizontal link member to the front support member is 35-45% shorter than the distance between the coupling places of the front support member and the rear support member to the frame member. This feature makes the frame support structure more stable.

In a thirteenth embodiment of the trampoline, the front support member and the rear support member comprise foot supporters that are pivotally coupled to the lower ends of the support member shafts of the front support member and the rear support member. The foot supporters have non slip such as a rubber bottom surface. This feature makes the frame support structure more stable and safer when it is used. The foot supporters of the rear support member comprise wheels that are mounted on the top side of the foot supporters. When the foot supporters are flipped the wheels can be used to help the moving of the trampoline.

In a fourteenth embodiment of the trampoline, the front support member and the rear support member are identical. This feature eases the manufacturing and logistics.

In a fifteenth embodiment of the trampoline, the trampoline comprises two elongated frame members with longitudinal axis perpendicular to the front line of the trampoline, the frame members are positioned on opposite sides of the rebounding mat and the frame members not directly coupled together. This feature makes the trampoline safer to use, because there is no frame member on the front line or the rear line of it.

In a sixteenth embodiment of the trampoline, the intermediate bars of the front support member and the rear support member comprise fixing hooks that are arranged to fit into the fixing holes on the support member shafts configured in such a way that the intermediate bar can be detached from the support member shafts and the trampoline can be collapsed in width direction. This feature makes it easier to store or transport the trampoline.

In some embodiments of the invention is a trampoline frame support structure in which the front support member, the rear support member, the horizontal link members and the adjusting link members are configured in a such way that the tilt angle of the frame and the rebounding mat shifts when the coupling place of the adjustable link members on the horizontal link members is adjusted. The coupling arrangement between the adjustable link members and the horizontal link members is a mounting bracket that is pivotally coupled to the lower end of the adjusting link member and is movable coupled on the horizontal link member. The mounting brackets are locked up to the horizontal link members with locking drop-in pins that are fitted into holes on the horizontal link members. The horizontal link members comprise a plurality of holes that are used to lock up the mounting brackets to predefined coupling places and to set the tilt angle of the frame and the rebounding mat to predefined angles. In one embodiment of the invention, the predefined tilt angles are 0, 5, 10, 15, 20 and 25 degrees towards the front side of the trampoline. This feature makes it easier to set the desired tilt angle of the rebounding mat.

In some embodiments of the trampoline frame support structure, the mounting bracket comprises an elastic element such as a spring that drives the locking drop-in pin into the hole on the horizontal link member and locks up the mounting bracket to the horizontal link member. This feature ensures that the trampoline frame support structure is locked up and safe to use. In some embodiments of the trampoline frame support structure, the locking drop-in pin comprises an elongated pin, a circular base collar with a substantially spiral raised surface perpendicular to the longitudinal axis of the pin and a level member coupled to the base collar. The locking drop-in pin is fitted in to a recess on one side of the mounting bracket and the recess has a circular inner wall and a spiral raised bottom surface that correspond to the shape of the base collar. The spiral raised surfaces of the recess and the base collar are configured in such a way that when the locking drop-in pin is rotated in the recess the locking drop-in pin moves perpendicular to its longitudinal axis out of the hole on the horizontal link member and the mounting bracket is unlocked up to the horizontal link member. The spiral raised surfaces of the recess and the base collar comprise two sections each having substantially planar chamfered surfaces with chamfering direction opposite each other and the angle of chamfering is between 15 and 30 degreed, preferable between 20 and 25 degrees. This feature makes it easier to unlock the mounting bracket from the horizontal link member to be able to adjust the tilt angle of the rebounding mat.

In some embodiments of the trampoline frame support structure, the locking drop-in pin is rotated by pulling a handle that is coupled to the frame of the rebounding mat and connected by a cable to the level member.

In some embodiments of the trampoline frame support structure, the horizontal link member comprises locking slots and locking members on both ends. The locking slot opens, and the horizontal link member can be detached from the front support member and the rear support member when the locking member is moved outward from the horizontal link member to the direction parallel to the longitudinal axis the horizontal link member. When the horizontal link members are detached from the front support member and the rear support member, the trampoline frame support structure can be folded down so that it takes less space. This feature makes it easier to store or transport the trampoline.

In some embodiments of the trampoline frame support structure, the front support member and the rear support member are tilted inward and the distance between the coupling places of the front support member and the rear support member to the horizontal link member is 60-70% longer than the distance between the coupling places of the front support member and the rear support member to the frame and the distance between the coupling places of the frame and the horizontal link member to the front support member is 35-45% shorter than the distance between the coupling places of the front support member and the rear support member to the frame. This feature makes the frame support structure more stable.

In some embodiments of the trampoline frame support structure, the front support member and the rear support member comprise foot supporters that are pivotally coupled to the lower ends of the front support member and the rear support member. The foot supporters have non slip such as a rubber bottom surface. This feature makes the frame support structure more stable and safer when it is used. In some embodiments of the trampoline frame support structure, the front support member and the rear support member are identical. This feature eases the manufacturing and logistics.

One embodiment of the invention is a trampoline comprising a tiltable frame support structure. In one advantageous embodiment, the frame support structure comprises support members and link members as was described before.

In some embodiments of the trampoline, the rebounding mat is substantially rectangular and the frame of the rebounding mat comprises only two elongated frame members with longitudinal axis perpendicular to the front line of the trampoline positioned on two opposite sides of the rebounding mat and the frame members are not directly coupled together. This feature makes the trampoline safer to use, because there is no frame member on the front line or the rear line of it.

It is an advantage of the invention that it provides a trampoline that is stable, durable, safe to use and can be easily folded down for storage or transportation.

It is a further advantage of the trampoline frame support structure that it is rigid and can be easily adjusted for different tilt angles to direct the rebound direction of a jump.

BRIEF DESCRIPTION OF THE SEVERAL VIEWS OF THE DRAWINGS

Further advantages, features, and details of the various embodiments of this disclosure will become apparent from the ensuring description of a preferred exemplary embodiment and with the aid of the drawings. The features and combinations of features recited below in the description, as well as the features and feature combination shown after that in the drawing description or in the drawings alone, may be used not only in the particular combination received, but also in other combinations on their own, without departing from the scope of the disclosure.

In the following, the invention is described in detail. The description refers to the accompanying drawings, wherein.

DETAILED DESCRIPTION OF THE INVENTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B or C", then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that at least one of "A, B, and C" should not be understood as including only one of A, only one of B, only one of C, or any combination of A, B, and C.

The embodiments in the following description are given as examples only and someone skilled in the art can carry out the basic idea of the invention also in some other way than what is described in the description. Though the description may refer to a certain embodiment or embodiments in several places, this does not mean that the reference would be directed towards only one described embodiment or that the described characteristic would be usable only in one described embodiment. The individual characteristics of two or more embodiments may be combined and new embodiments of the invention may thus be provided.

Figure 1:
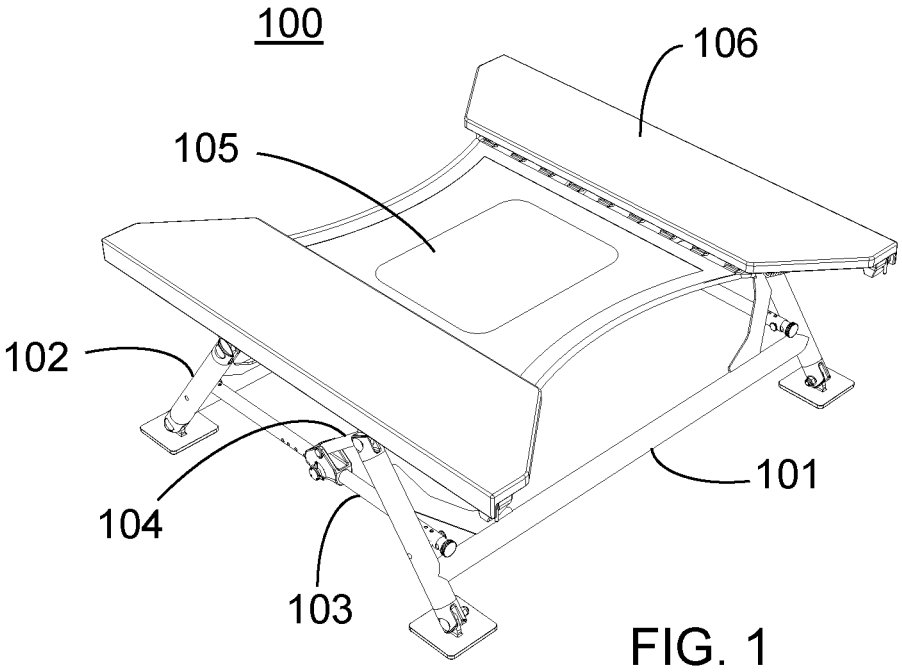
FIG. 1 shows an example of a trampoline according to an embodiment.

FIG. 1 shows an embodiment of a trampoline 100. The trampoline comprises a front support member 101, a rear support member 102, two elongated link members 103, two elongated adjusting link members 104, a rebounding mat 105 and spring pads 106. Both support members comprise two support member shafts having upper ends and lower ends of the support member shafts and an intermediate bar between said support member shafts. The two support member shafts and the intermediate bar are fixed each other forming a shape like letter H, where the upright lines are the support member shafts and the line between them is the intermediate bar.

Figure 2:
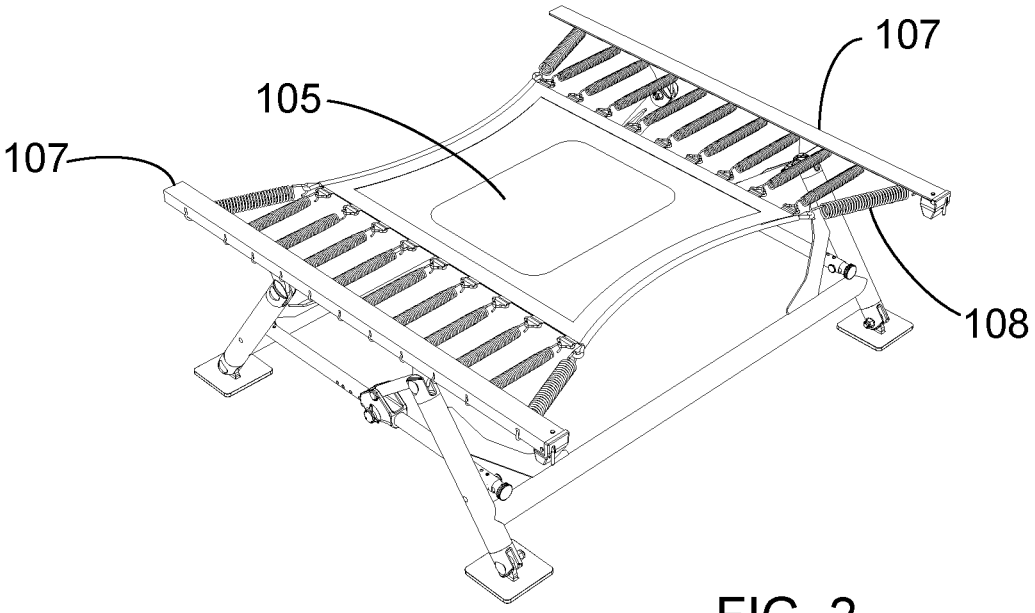
FIG. 2 shows the trampoline presented in FIG. 1 without spring pads.

FIG. 2 shows two frame members 107 and a multitude of spring elements 108 of the trampoline presented in FIG. 1 when spring pads are removed. The mat 105 is kept in its place with the spring elements that are coupled between the frame members and the rebounding mat. These spring elements provide the bouncing effect for the user of the trampoline.

Figure 3:
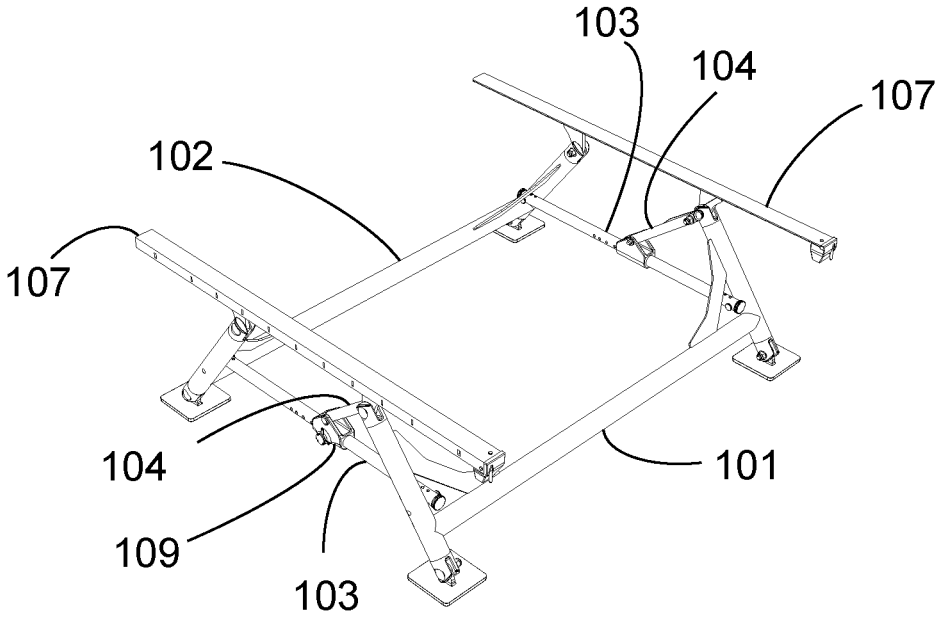
FIG. 3 shows the frame and the frame support structure of the trampoline presented in FIG. 1.

FIG. 3 shows a frame support structure of the trampoline presented in FIG. 1. The adjusting link members 104 have upper ends and lower ends. The trampoline comprises at least two mounting brackets 109. The front support member 101 and the rear support member 102 are pivotally coupled to the frame members 107. The horizontal link members 103 are pivotally coupled between the front support member and the rear support member. The upper ends of the adjusting link members 104 are pivotally coupled to the upper ends of the front support member and the lower ends of the adjusting link members are coupled to the horizontal link members with mounting brackets 109 in a such way that the coupling place can be adjusted. The mounting bracket is pivotally coupled to the lower end of the adjusting link member and is movable coupled on the horizontal link member.

Figure 4:
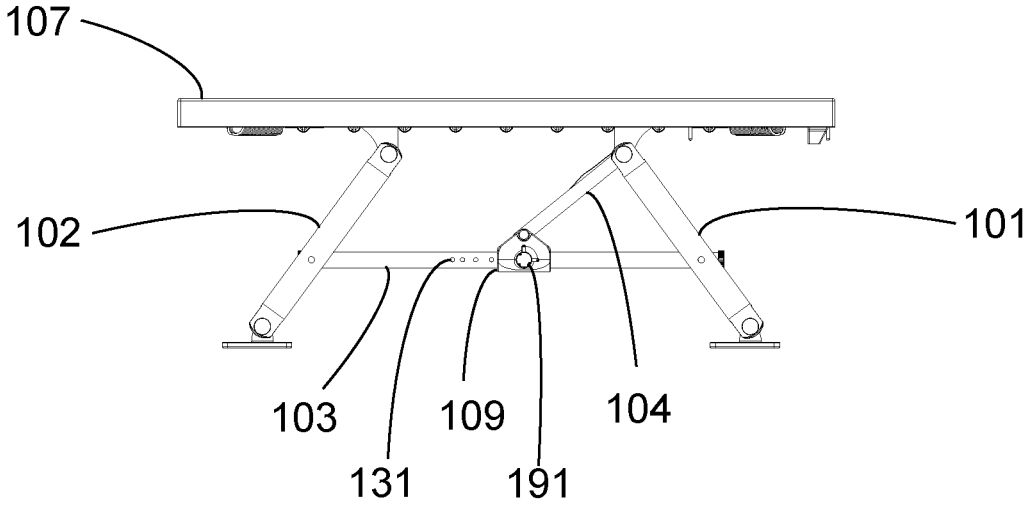
FIG. 4 shows a side view of a trampoline frame support structure presented in FIG. 3 with tilt angle of 0 degrees.

FIG. 4 shows a side view of a trampoline frame support structure presented in FIG. 3 when the frame member 107 is in horizontal position. The mounting bracket comprises a locking drop-in pin 191. The horizontal link members 103 comprise a plurality of holes 131 that are used to lock up the mounting brackets 109 and the adjusting link members 104 to predefined coupling places. The mounting bracket is locked up to the horizontal link member with the locking drop-in pin 191 that is fitted into a hole on the horizontal link member. When the mounting brackets are locked up to the horizontal link members, the front support member 101 and the rear support member 102 cannot pivot and thus the tilt angle of the frame remains fixed.

Figure 5:
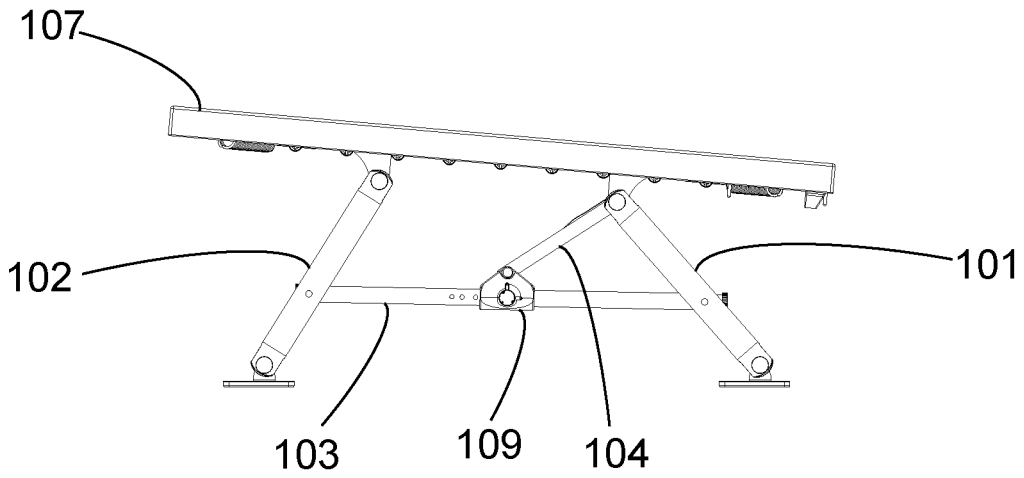
FIG. 5 shows a side view of the trampoline frame support structure presented in FIG. 3 with tilt angle of 5 degrees.

FIG. 5 shows a side view of the trampoline frame support structure presented in FIG. 3, when the frame member 107 has tilt angle of 5 degrees. When the coupling place of the mounting bracket 109 on the horizontal link member 103 is moved towards the rear support member 102, the adjusting link member 104 causes the upper end of the front support member 101 to tilt towards the rear support member and further the frame member 107 to tilt towards the front line of the trampoline.

Figure 6:
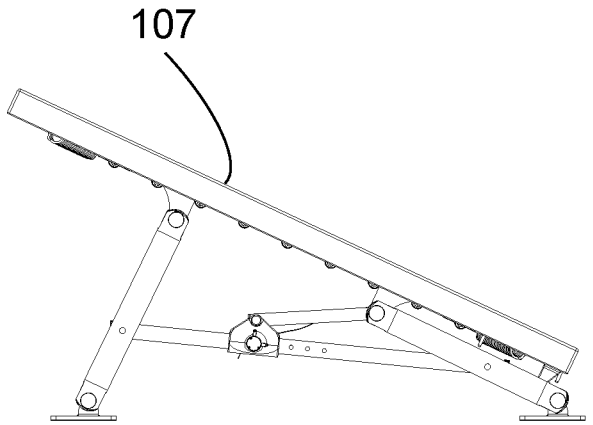
FIG. 6 shows a side view of the trampoline frame support structure presented in FIG. 3 with tilt angle of 25 degrees.

FIG. 6 shows a side view of the trampoline frame support structure presented in FIG. 3 when the frame member 107 has tilt angle of 25 degrees.

Figure 7:
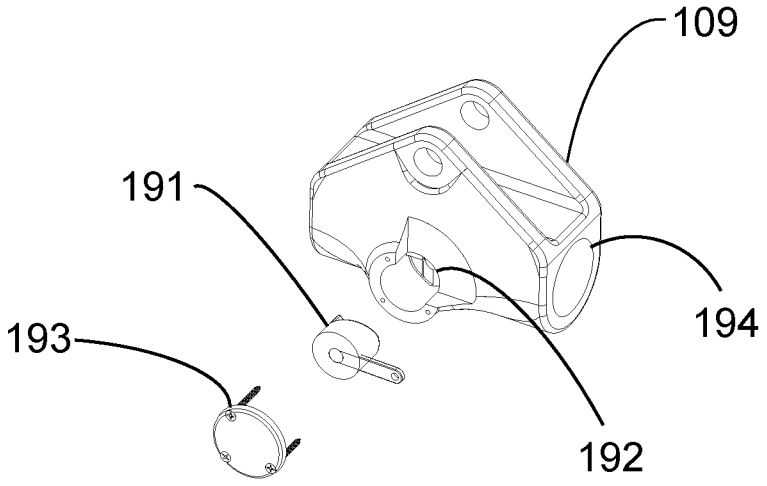
FIG. 7 shows an example of a mounting bracket and a locking drop-in pin according to an embodiment.

FIG. 7 shows an example of the mounting bracket 109 according to an embodiment. For illustrative purposes only the locking drop-in pin 191 is removed from a recess 192. In normal operation mode the locking drop-in pin is fitted into the recess and a cover member 193 is fixed on the mounting bracket such a way that the locking drop-in pin stays in the recess. An elastic element such as a spring is placed between the locking drop-in pin and the cover member to ensure that the locking drop-in pin is pressed to the bottom of the recess and in its locking position. The recess is perpendicular to a channel 194 into which the horizontal link member is fitted in normal operation mode.

Figure 8:
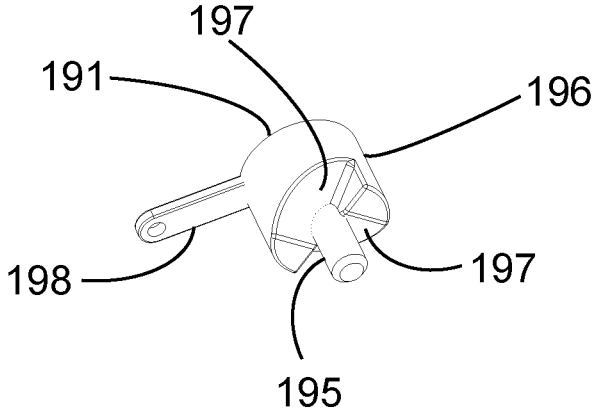
FIG. 8 shows a locking drop-in pin and its spiral raised surface according to an embodiment.

FIG. 8 shows a locking drop-in pin 191 according to an embodiment. An elongated pin 195 erects outwards from a circular base collar 196. The base collar has a spiral raised surface comprising two sections each having chamfered surfaces 197. In normal operation mode the spiral raised surface and the chamfered surfaces are pressed towards the bottom of the recess 192 shown in FIG. 7. A level member 198 is coupled to the base collar so that the locking drop-in pin can be easily rotated in the recess. The level member is connected by a cable to a handle that is coupled to the front end of the frame member 107 shown in FIG. 3 so that when the handle is pulled the level member moves and rotates the locking drop-in pin. When the locking drop-in pin is rotated in the recess the locking drop-in pin moves perpendicular to its longitudinal axis.

Figure 9:
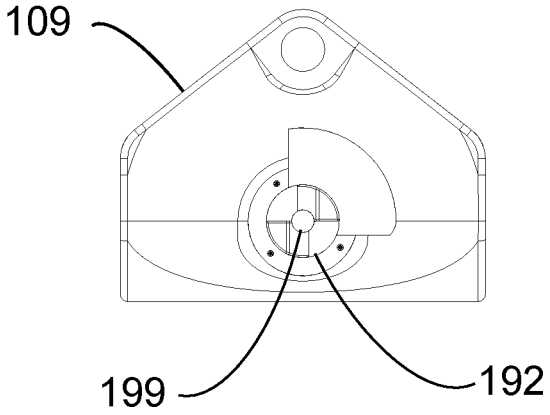
FIG. 9 shows a side view of the mounting bracket presented in FIG. 7.

FIG. 9 shows a side view of the mounting bracket 109 presented in FIG. 7. At the bottom of the recess 192 is an opening 199 into which the pin 195 of the locking drop-in pin 191 shown in the FIG. 8 is inserted. The recess has a circular inner wall and a spiral raised bottom surface with chamfered surfaces that correspond to the shape of the base collar 196 shown in the FIG. 8. When the locking drop-in pin is rotated in the recess, the chamfered surfaces of the recess and the locking drop-in pin forces the locking drop-in pin to move outward from the recess and the mounting bracket.

Figure 10:
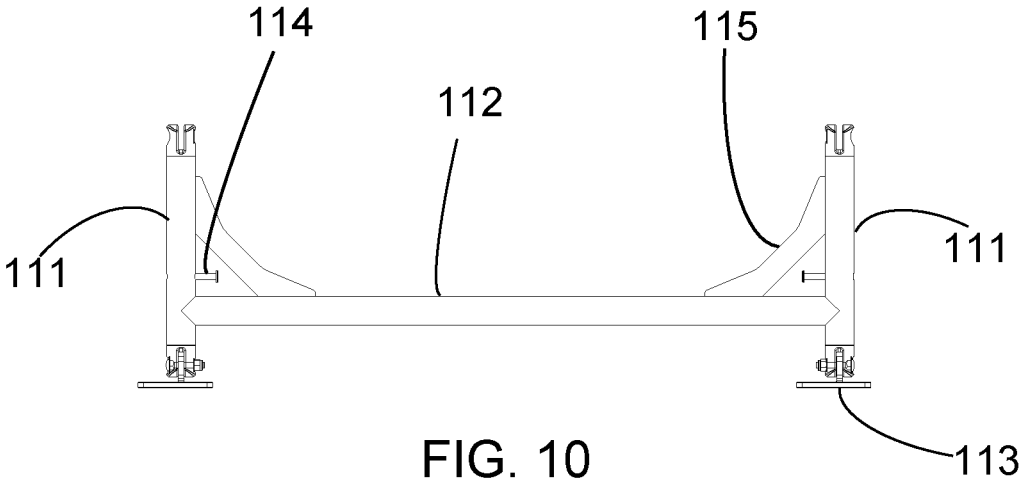
FIG. 10 shows a support member according to an embodiment.

FIG. 10 shows the front support member 101 of the frame support structure presented in FIG. 3 comprising the support member shafts 111 and the intermediate bar 112 between the support member shafts. Foot supporters 113 are pivotally coupled to the lower ends of the front support member. Circular shaft members 114 with horizontal longitudinal axis parallel to the front line of the trampoline are fixed to the front support member so that the horizontal link members 103 show in FIG. 3 can be easily coupled to the front support member. Reinforcement members 115 are used to obtain durable and rigid structure.

Figure 11:
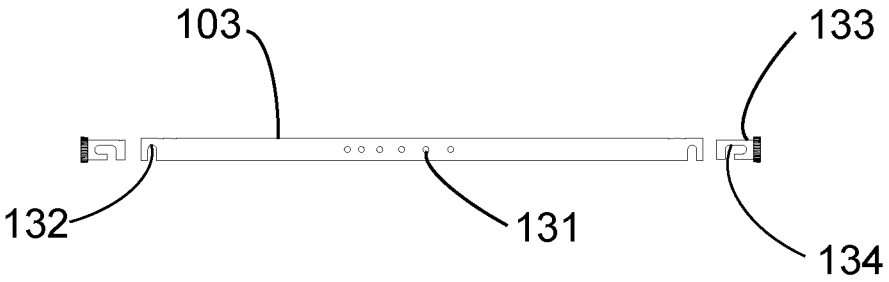
FIG. 11 shows a horizontal link member according to an embodiment.

FIG. 11 shows a side view of a horizontal link member 103 according to an embodiment. On one side of the horizontal link member there are a plurality of holes 131 that are used to lock up the mounting bracket 109 shown in FIG. 7 to the horizontal link member. When the mounting bracket is locked up to the horizontal link member, the pin of the locking drop-in pin shown in FIG. 8 is fitted into the hole on horizontal link member. Each individual hole is used to set the tilt angle of the rebounding trampoline for a desired predefined angle. The locking slots 132 and locking members 133 on both ends of the horizontal link members are used to couple and decouple the horizontal link member to the front support member 101 and the rear support member shown in FIG. 3. In normal operational mode the shaft member 114 shown in the FIG. 10 is on the locking slot and the locking member fitted into the end of the horizontal link member so that the locking member closes the locking slot. The locking member comprises an L-shape slot 134 configured in such a way that when the locking members are moved a certain distance outward from the horizontal link member, the locking slots open so that the horizontal link member can be decoupled from the front support member and the rear support member.

Figure 12:
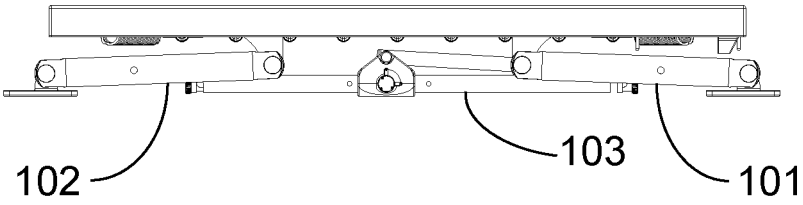
FIG. 12 shows a trampoline according to an embodiment that is folded down.

FIG. 12 shows a trampoline according to an embodiment that is folded down after the horizontal link members 103 are decoupled from the front support member and the rear support member.

Figure 13:
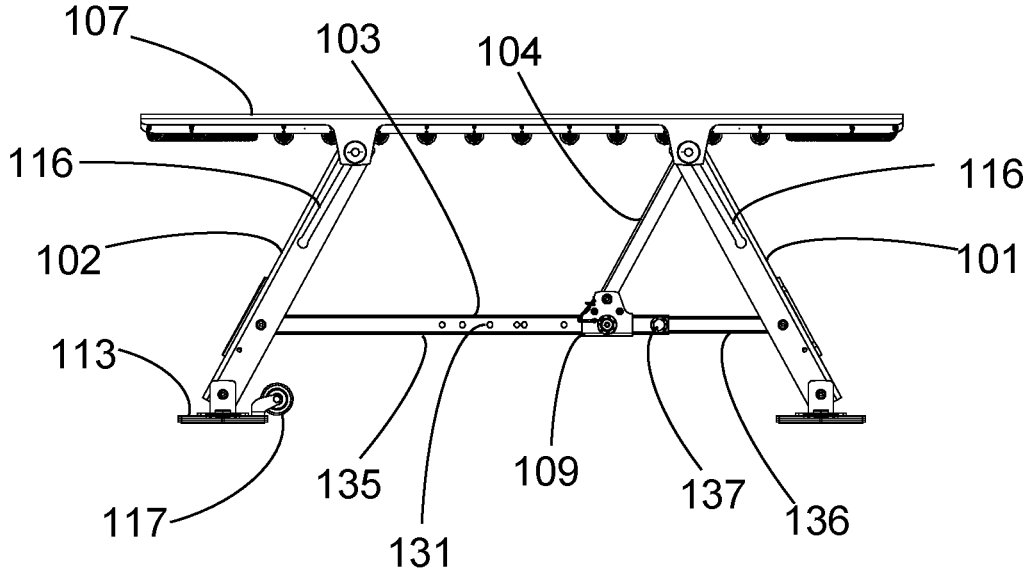
FIG. 13 shows a side view of a trampoline according to an embodiment with tilt angle of 0 degrees.

FIG. 13 shows a side view of a trampoline according to an embodiment in normal operation mode with the frame member 107 in horizontal position. The front support member 101, the rear support member 102, the horizontal link member 103 and the adjusting link member 104 are configured in a such way that the tilt angle of the frame member shifts when the coupling place of the mounting bracket 109 is adjusted. The horizontal link member 103 is a telescopic pipe structure comprising the outer pipe 135, the inner pipe 136 fitted into the outer pipe and adapted to move relative to the outer pipe, and the fixing pin 137 that is fitted into the fixing holes on the inner pipe to fix the inner pipe in place for normal operation mode. The support member shafts of the front support member 101 and the support member shafts of the rear support member 102 comprise elongated slots 116 at the upper ends and the frame member 107 is coupled at the upper end of the elongated slots for the normal operation mode. The foot supporter 113 of the rear support member 102 comprises wheel 117 that is mounted on the top side of the foot supporter.

Figure 14:
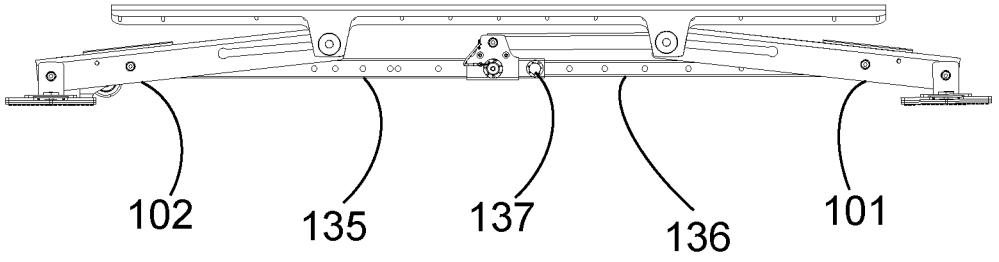
FIG. 14 shows a trampoline presented in FIG. 13 that is folded down.

FIG. 14 shows a trampoline presented in FIG. 13 when the telescopic pipe structure of the horizontal link member is extended and the trampoline is folded down. The inner pipe 136 is moved outward from the outer pipe 135 to allow and the front support member 101 and the rear support member 102 to be pivoted and the trampoline frame support structure to be folded down. The inner pipe is fixed in place into the outer pipe with the fixing pin 137 to lock the trampoline for the folded mode.

Figure 15:
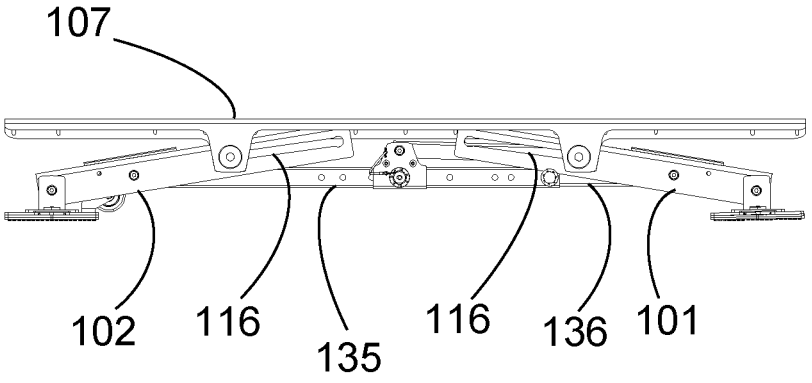
FIG. 15 shows a trampoline presented in FIG. 13 that is folded down and the support member shaft pushed inwards.

FIG. 15 shows a trampoline presented in FIG. 13 that is first folded down as presented in FIG. 14 and after that the support member shafts of the front support member 101 and the rear support member 102 are pushed inwards. The inner pipe 136 is moved inward to the outer pipe 135 to allow the coupling place between the support member shafts and the frame member 107 to be moved within the elongated slots 116 away from the upper end of the support member shafts.

Figure 16:
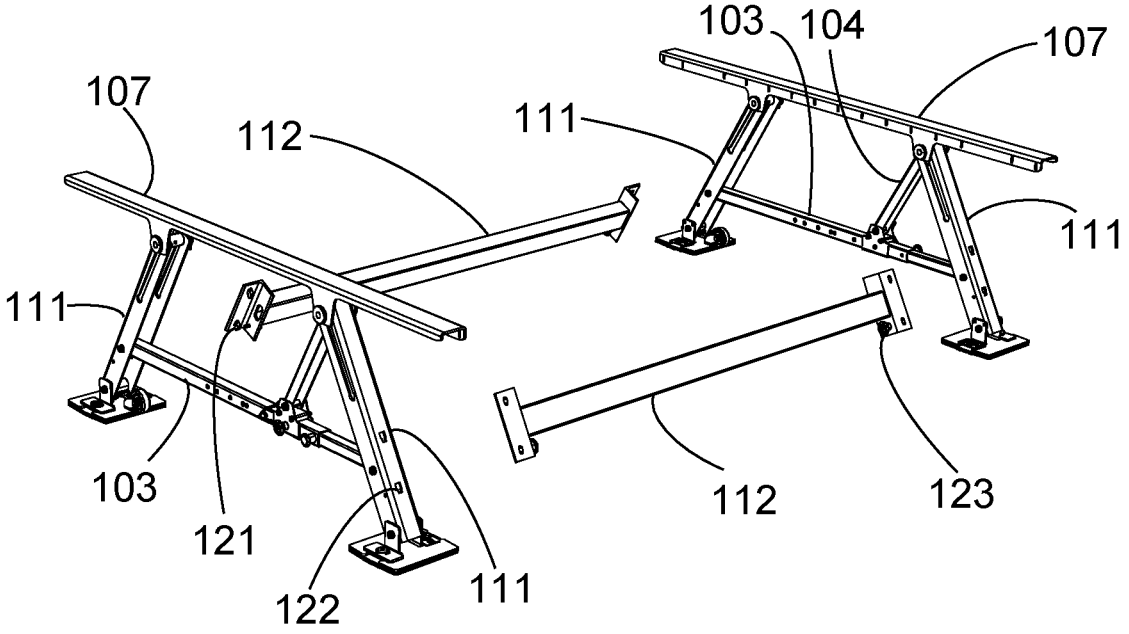
FIG. 16 shows a frame and a frame support structure of a trampoline according to an embodiment with the intermediate bars of the front support member and the rear support member detached.

FIG. 16 shows a frame and a frame support structure of a trampoline according to an embodiment with the intermediate bars 112 of the front support member and the rear support member detached from the support member shafts 111. The intermediate bar 112 comprises fixing hooks 121 that are arranged to fit into the fixing holes 122 on the support member shafts 111 to fix the intermediate bar to the support member shafts. The intermediate bar 112 further comprises a locking plug 123 to ensure the fixing of the intermediate bar to the support member shaft 111. The trampoline comprises two elongated frame members 107 with longitudinal axis perpendicular to the front line of the trampoline. When the spring elements and the rebounding mat are detached from the frame members 107, the support member shafts 111, the horizontal link member 103, the adjusting link member 104 and the frame member 107 are folded down as presented in FIG. 15 and the intermediate bars 112 of the front support member and the rear support member are detached from the support member shafts 111, the trampoline can be fitted into a compact elongated box for transportation.

Some advantageous embodiments of the method and apparatus according to the invention have been described above. The invention is however not limited to the embodiments described above, but the inventive idea can be applied in numerous ways within the scope of the claims.

Since the devices and methods described in detail above are examples of embodiments, they can be modified to a wide extent by the skilled person in the usual manner without departing from the scope of the invention. In particular, the mechanical arrangements and the proportions of the individual elements with respect to each other are merely exemplary. Some preferred embodiments of the apparatus according to the invention have been disclosed above. The invention is not limited to the solutions explained above, but the innovative solutions can be applied in different ways within the limits set out by the claims.

The invention claimed is:

1. A trampoline, comprising:

a substantially rectangular rebounding mat;

a plurality of frame members;

a plurality of spring elements arranged between the rebounding mat and the frame members; and a support arrangement underlying the rebounding mat and the frame members, the support arrangement comprising a front support member and a rear support member, each of the front support member and rear support member comprising two support member shafts and an intermediate bar arranged between the support member shaft, and the support member shafts comprise upper ends and lower ends of the support member shaft; and wherein the support arrangement further comprises two horizontal link members and two adjusting link members, the adjusting link members comprising an upper end and a lower end;

wherein the upper ends of the support member shafts of the front support member and the rear support member are pivotally coupled to the frame members, the horizontal link members are pivotally coupled between the front support member and the rear support member, the upper ends of the adjusting link members are pivotally coupled to the upper ends of the support member shafts of the front support member and the lower ends of the adjusting link members are movable coupled to the horizontal link members; and wherein the front support member, the rear support member, the horizontal link members and the adjusting link members are configured such that the tilt angle of the rebounding mat shifts when a coupling place of the adjustable link members to the horizontal link members is adjusted.

2. The trampoline according to claim 1, wherein the coupling place between the adjustable link member and the horizontal link member is a mounting bracket configured to be pivotally coupled to the lower end of the adjusting link member and be movable coupled on the horizontal link member.

3. The trampoline according to claim 2, wherein the horizontal link members comprise multiple holes and the mounting brackets are arranged locked up to the horizontal link members with locking drop-in pins fitted into the holes on the horizontal link members to set the tilt angle of the rebounding mat to selectable predefined angles.

4. The trampoline according to claim 3, wherein the mounting bracket comprises an elastic element configured to drive the locking drop-in pin into the hole on the horizontal link member and ensure that the locking drop-in pin is in its locking position.

5. The trampoline according to claim 4, wherein:

the mounting bracket comprises a recess;

the locking drop-in pin comprises an elongated pin and a circular base collar with a substantially spiral raised surface perpendicular to the longitudinal axis of the pin comprising at least two chamfered surfaces;

the locking drop-in pin is arranged in the recess, the mounting bracket further comprises a substantially spiral raised surface corresponding to the spiral raised surface of the base collar; and the spiral raised surfaces of the recess and the base collar are configured such that, when the locking drop-in pin is rotated in the recess, the chamfered surfaces of the recess and the locking drop-in pin force the locking drop-in pin to move outward from the recess and release the locking drop-in pin from its locking position.

6. The trampoline according to claim 5, wherein the chamfered surfaces comprise a chamfering direction opposite to each other and an angle of chamfering between 15 and 30 degrees.

7. The trampoline according to claim 6, wherein the angle of chamfering is between 20 and 25 degrees.

8. The trampoline according to any claim 1, wherein:

the horizontal link member comprises locking slots and locking members on its ends; and the locking member comprises an L-shape slot configured such that when the locking members are moved a distance outward from the horizontal link member, the locking slots open so that the horizontal link member can be decoupled from the front support member and the rear support member.

9. The trampoline according to claim 1, wherein the horizontal link member comprises a telescopic pipe structure comprising an outer pipe, an inner pipe fitted into the outer pipe and adapted to move relative to the outer pipe, and a fixing pin configured such that when the length of the telescopic pipe structure of the horizontal link member is extended, the front support member and the rear support member pivot and the trampoline folds down.

10. The trampoline according to claim 1, wherein the support member shafts of the front support member and the rear support member comprise elongated slots at the upper ends of the support member shafts configured such that the coupling between the support member shafts and the frame member can be loosened so that the coupling place of the support member shaft to the frame member can be moved away from the upper end of the support member shaft and the support member shaft can be pushed inwards when the trampoline is folded down.

11. The trampoline according to claim 1, wherein:

the rear support member comprises foot supporters coupled to the lower ends of the support member shafts; and the foot supporters further comprise wheels mounted on the top side of the foot supporters, the wheels configured such that when the foot supporters are flipped, the wheels enable movement of the trampoline.

12. The trampoline according to claim 1, wherein the front support member and the rear support member are identical.

13. The trampoline according to claim 1, wherein:

the trampoline comprises two elongated frame members with longitudinal axis perpendicular to a front line of the trampoline; and the frame members are arranged on opposite sides of the rebounding mat and not directly coupled together.

14. The trampoline according to claim 13, wherein the intermediate bars comprise fixing hooks arranged to fit into the fixing holes on the support member shafts configured such that the intermediate bar is detachable from the support member shafts and the trampoline is enabled to collapse in a width direction.

* * * * *